United States Patent [19]

Graf

[11] 4,015,638

[45] Apr. 5, 1977

[54] HEDDLE FRAME ON WHICH THE LATERAL SUPPORTS ARE DETACHABLY CONNECTED TO THE FRAME STAVES

[75] Inventor: Martin Graf, Wuehrenbach, Switzerland

[73] Assignee: Grob & Co. Aktiengesellschaft, Horgen, Switzerland

[22] Filed: Mar. 16, 1976

[21] Appl. No.: 667,322

[30] Foreign Application Priority Data

Mar. 25, 1975 Switzerland ..... 3820/75

[52] U.S. Cl. ..... 139/91

[51] Int. Cl.[2] ..... D03C 9/06

[58] Field of Search ..... 139/91, 92

[56] References Cited

UNITED STATES PATENTS

| | | | |
|---|---|---|---|
| 719,080 | 1/1903 | Bracken | 139/91 |
| 3,335,759 | 8/1967 | Koch | 139/91 |
| 3,753,450 | 8/1973 | Koch | 139/91 |

*Primary Examiner*—Henry S. Jaudon
*Attorney, Agent, or Firm*—Sughrue, Rothwell, Mion, Zinn & Macpeak

[57] ABSTRACT

The lateral support of the heddle frame is provided with a projection which is received in a complementary recess in the end of the frame stave. The upper surface of the projection is provided with a bevelled surface. A screw extends diagonally into the recess from the outer edge of the frame stave adjacent the lateral support with the central axis of the screw disposed perpendicular to the bevelled surface to prevent the withdrawal of the projection from the recess when the end of the screw is disposed in engagement with the bevelled surface. The projection may additionally be provided with a spring biased pivot disposed parallel to the length of the lateral support for automatic engagement in an aperture near the entrance of the recess upon partial withdrawal of the projection from the recess after the screw has been backed off from the bevelled surface to allow the lateral support to be pivoted away from the end of the frame stave to expose the corresponding end of the heddle rod for the addition or removal of heddles. A plunger may be provided in the aperture for ejecting the spring biased pivot to permit full removal of the projection on the lateral support from the recess in the frame stave.

13 Claims, 9 Drawing Figures

HEDDLE FRAME ON WHICH THE LATERAL SUPPORTS ARE DETACHABLY CONNECTED TO THE FRAME STAVES

BACKGROUND OF THE INVENTION

1. Field of the Invention

The present invention is directed to heddle frames and more specifically to the detachable and/or pivoted connection between the lateral support and the frame stave.

2. Prior Art

In their basic design most heddle frames consist of two frame staves which are connected at their ends by means of two lateral supports. Originally, these lateral supports were firmly rivetted or welded on the frame staves and could not be removed. Recently, however, removable lateral supports have become more common and many different constructions of heddle frames with removable lateral supports are known. The most commonly used constructions of heddle frames include lateral supports which are fixed to the frame staves by means of at least one screw extending through the lateral support into each frame stave. Up to now, two different kinds of screw joints have been used for this purpose. In the most simple construction the screw passes directly through the front of the lateral support and is fastened to the frame stave parallel to the longitudinal direction thereof. In a second screw joint construction, the lateral supports are provided with protruding portions which embrace the ends of the frame staves in the longitudinal direction of the frame staves or which protrude into hollow spaces in the frame staves. The screw in this case passes parallel to the longitudinal direction of the lateral support and connects the frame stave with the protruding portions of the lateral support. Both of the above mentioned screw joints have proved successful and will remain in use in some fields of application.

However, several disadvantages have given rise to the need to find a better detachable connection between frame staves and lateral supports. In many applications, the thickness of the lateral supports corresponds to the pitch of the shedding mechanism of the loom so that the adjoining lateral supports of heddle frames glide on each other and simultaneously serve as a guide. Screw fastening arrangements wherein the screw passes through the lateral support and is screwed into the end of the frame stave are suitable for this type of construction. However, on modern weaving machines each individual heddle frame is guided on the lateral support. The lateral supports do not glide on each other but are spaced apart a distance which is determined by guides fitted onto the weaving machine. The lateral supports for this application are mainly of metal having a profiled shape along their longitudinal axis. On such lateral supports there is usually no space available for a screw to be located. In such cases the screw is introduced parallel to the lateral support. The screw is fastened in such instances at a given distance to the lateral support from the outer edge of the frame stave. In several constructions this placement is not possible since frame stave suspension elements for driving the heddle frame have to be mounted on the outer edge of the frame staves closely adjacent to the lateral support. The limited space availability therefore often resulted in improper screw connections between the lateral supports and the frame staves.

Since the arrangement of screws in the two directions discussed above do not provide a suitable design the location of the screw in a third direction orthogonal to the longitudinal axis of the frame stave and the lateral support was considered. This variation, however, had to be eliminated since the thickness of the heddle frame in this direction was not sufficient for the length of the screw to provide a strong connection. Furthermore, the screws would not be accessible when the frames would be piled on each other or would be placed into the weaving machine.

SUMMARY OF THE INVENTION

The present invention provides a screw type connection between a lateral support of a heddle frame and the frame stave which eliminates the aforementioned disadvantages of conventional heddle frames and provides a heddle frame having an improved screw connection between the frame stave and the lateral support which can be readily secured or loosened by a few turns of screws.

The present invention provides an arrangement wherein a clamping screw is disposed in the plane of the heddle frame but is inclined to the axis of the lateral support and the axis of the frame stave while being inserted from outside the heddle frame and guided in the frame stave. The screw is perpendicular to an inclined surface on a projecting portion of the lateral support disposed within a recess in the end of the frame stave so that the lateral support is pulled against the frame stave by a component of force which acts perpendicular to the axis of the lateral support and simultaneously clamps the projecting portion of the lateral support within the recess by a component of force which is parallel to the axis of the lateral support. The screw is inserted directly at the end corner of the frame stave adjacent the end of the lateral support at an angle to the longitudinal axis of the lateral support and at an angle to the longitudinal axis of the frame stave. The adjacent corners of the lateral support and the frame stave may be bevelled to allow the screw head to be substantially recessed so as to present a relatively smooth profile on the heddle frame.

The present invention provides an arrangement such that after loosening of the screw the lateral support will not be fully disengaged from the frame stave but which will allow the partial withdrawal of the projecting portion of the lateral support from the recess in the end of the frame stave to an extent which will permit the pivoted displacement of the lateral support out of the plane of the frame stave to obtain access to the end of the heddle rod which is disposed parallel to and supported by the frame stave. In order to accomplish this the projecting portion of the lateral support is provided with a spring biased pivot pin which is normally recessed within the projecting portion when the projecting portion is fully inserted into the recess in the frame stave. An aperture is provided in the frame stave adjacent the open end of the recess so that upon partial withdrawal of the projecting portion the hinge pin will be biased outwardly into simultaneous engagement with the projecting portion and the aperture to provide a pivotal connection between the lateral support and the frame stave. The projecting end portions of the lateral support can be suitably shaped to allow this pivotal movement in the event that the lateral support has to be completely removed which may be necessary to work in conjunction with an automatic drawing-in machine. The projecting portions of the pivot pins can readily be disengaged from the aperture in the frame stave by means of a plunger.

The foregoing and other objects, features and advantages of the invention will be apparent from the following more particular description of preferred embodiments of the invention as illustrated in the accompanying drawings.

DETAILED DESCRIPTION OF THE PREFERRED EMBODIMENTS

Figure 1:
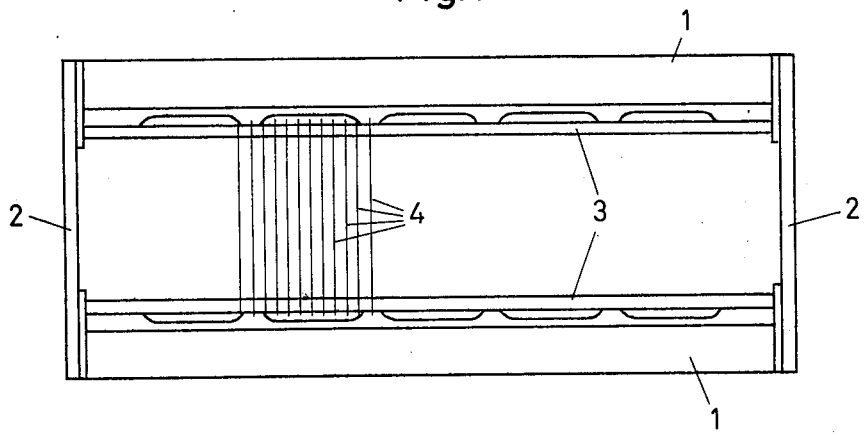
FIG. 1 is a front elevation view of a heddle frame.
Figure 2:
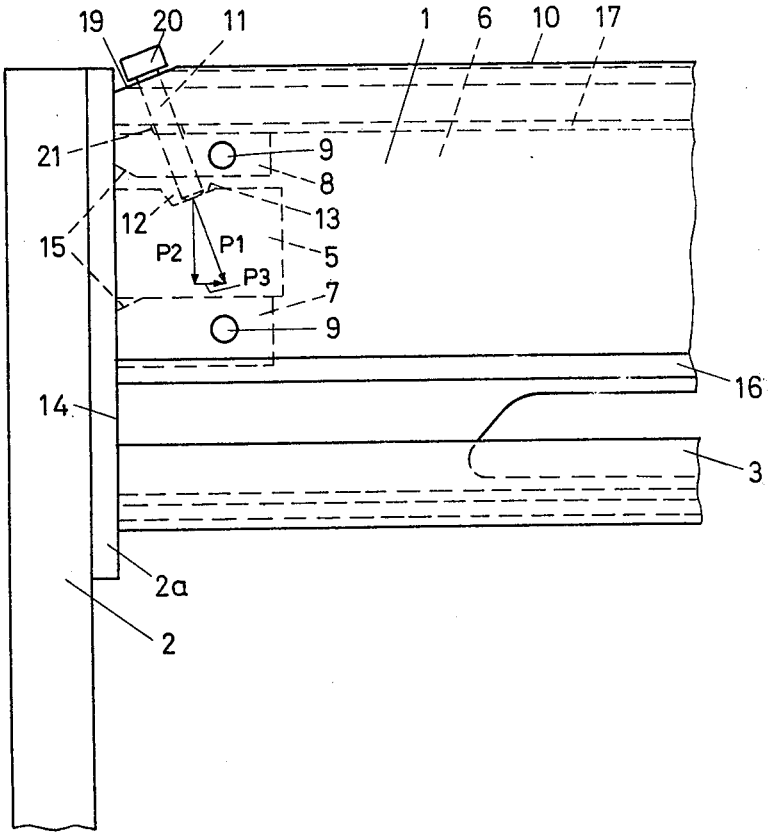
FIG. 2 is a partial view of a corner joint of the heddle frame according to a first embodiment of the present invention.

In FIG. 1, which is a front view of a heddle frame, the frame staves are shown connected to and extending between the lateral supports 2. On the heddle carrying rods 3 which are fixed to the frame staves 1, some heddles 4 have been shown. In the following drawings only partial views of a representative corner joint between a frame stave 1 and a lateral support 2 are shown.

The lateral support 2 is provided adjacent each end with a plate 2*a* which covers the complete end of the assembly which is comprised of the frame stave 1 and the heddle carring rod 3. A projection 5 is disposed on the plate 2*a* and may be of integral one-piece construction with the plate 2*a* or may be a separate element secured thereto by any suitable means. The projection 5 is disposed within the recess 6 in the frame stave end. On opposite sides of the projection 5 two plates 7 and 8 are also disposed within the recess 6 and secured therein by means of rivets 9. The plate 8 which is disposed closest to the outer edge 10 of the frame stave 1 is provided with a diagonal threaded aperture for threaded engagement with the screw 11. The projection 5 is provided with a bevelled recess 12 which presents a pressure surface 13 perpendicular to the central axis of the screw 11.

Due to the angle of the screw 11 the force P1 exerted by the screw against the surface 13 is divided into two force components P2 and P3. The vertical force component P2 presses the projection 5 against the pressure plate 7 whereas the horizontal force component P3 forces the projection 5 into the recess 6 to draw the plate 2*a* of the lateral support 2 tightly against the end of the frame stave 1.

The sides of the pressure plate 7 and the screw support plate 8 which are opposed to each other are provided with chamfering 15 adjacent the face 14 of the frame stave 1 to facilitate the insertion of the projection 5 into the recess 6. It is obvious that the chamfering could be provided on the ends of the projection 5 instead of on the plates 7 and 8 to accomplish the same result. The pressure plate 7 and the threaded plate 8 are preferably disposed against a wall or rib within the recess 6 of the frame stave so that the rivets 9 do not have to take up the complete force produced by the screw 11. In the examples shown in FIGS. 2–5 it was necessary to provide the pressure plate 7 with an inclined surface 18 in order to accommodate the inclined inner wall 16 of the frame stave 1. The screw support plate 8 bears against the rib 17 which provides additional support.

Figure 3:
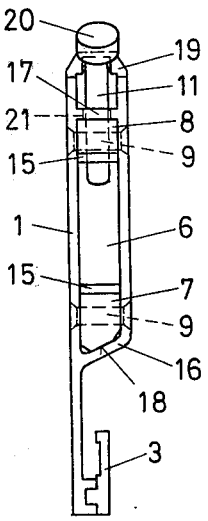
FIG. 3 is a side elevation view of the corner joint of FIG. 2 without the lateral support.

At the outer edge of the end of the frame stave 1, the corner adjacent the lateral support 2 is chamfered at 19 perpendicular to the central axis of the screw 11. Therefore, the length of the screw 11 can be chosen in such a way that the screw head 20 does not protrude too much beyond the outer edge 10 of the frame stave 1. In FIG. 3 the lateral support has been eliminated to illustrate more clearly how the pressure plate 7 with the inclined surface 18 as well as the screw support plate 8 with the screw 11 are arranged in a recess 6. The disconnection of the lateral support from the frame stave can be carried out very quickly since the screw 11 only has to receive a few turns to withdraw the screw from the pressure surface 13 to allow removal of the projection 5 from the recess 6. When the lateral support is separated from the frame stave the screw 11 can remain in the block 8. The screw 11 passes through the hole 21 in the rib 17 with sufficient clearance so that it is not necessary to provide any screw threads in the frame stave per se.

Figure 4:
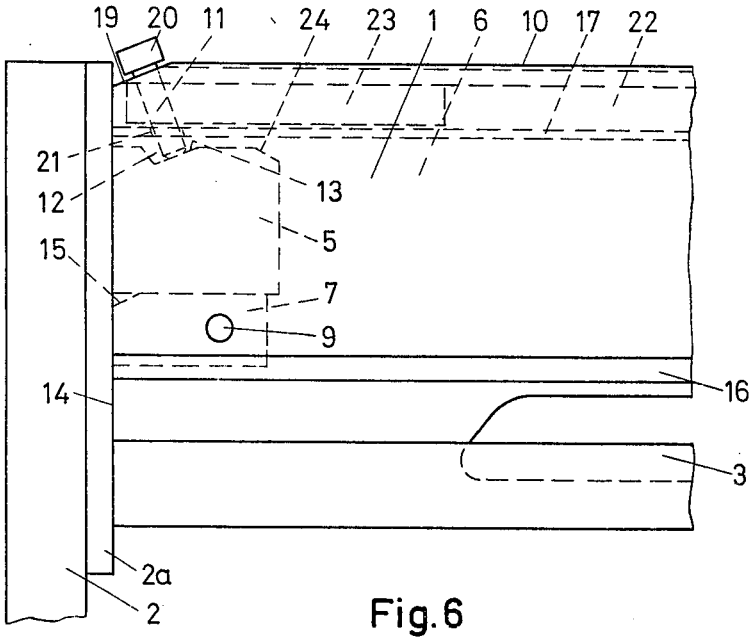
FIG. 4 is a partial view of the corner joint according to another embodiment of the present invention.
Figure 5:
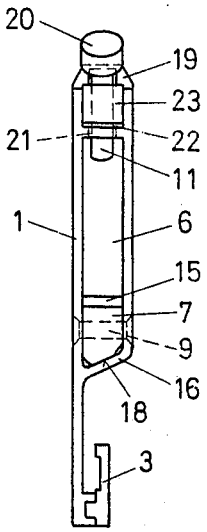
FIG. 5 is a side elevation view of the corner joint of FIG. 4 without the lateral support.
Figure 6:
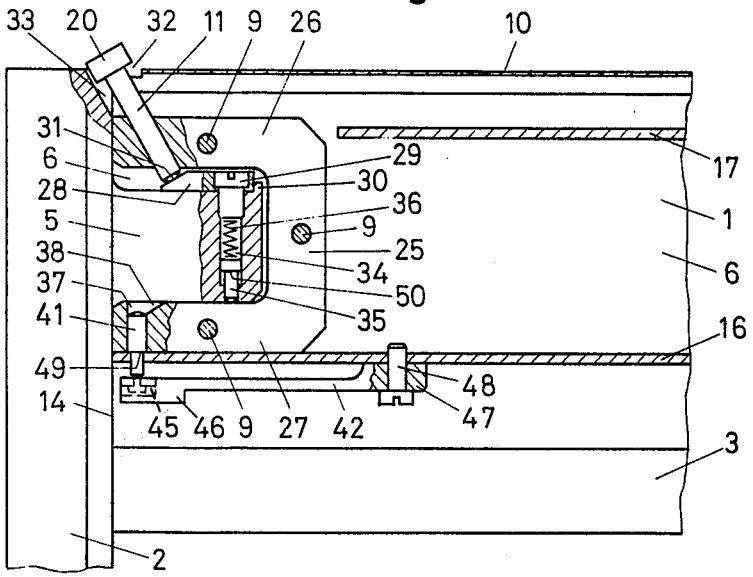
FIG. 6 is a partial sectional view of a corner joint of still another embodiment according to the present invention with a pivotal lateral support arrangement.
Figure 7:
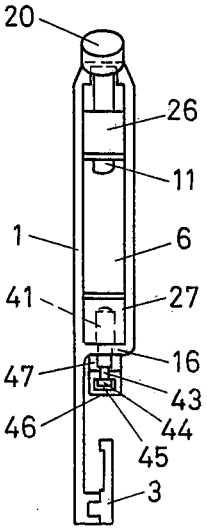
FIG. 7 is a side elevation view of the corner joint of FIG. 6 without the lateral support.

In the embodiment of FIGS. 4 and 5, the frame stave 1 is provided on its outer surface with a closed T-shaped channel 22. Instead of the support plate 8 having a threaded aperture as shown in the previous embodiment, a key 23 is inserted in this channel 22. Due to the restriction of play on all sides of the key 23 in the channel 22 an additional fastening by means of rivets is not necessary. The screw 11 is threaded through an aperture in the key 23 and projects through the hole 21 of rib 17 to secure the key 23 longitudinally within the channel 22. Since in this embodiment the support plate 8 with the chamfering 15 is not necessary, the projection 5 is provided with a chamfering 24 adjacent the rib 17 to facilitate the insertion of the projection 5 into the recess 6. The remainder of the construction of this embodiment is the same as the previous embodiment and operates in the same manner.

A further embodiment is shown in FIGS. 6–9 which is basically the same as the previous embodiments but additionally provides for a pivotal connection of the lateral support to the frame stave without the complete removal of the projection 5 on the lateral support from the recess 6 of the frame stave 1. The U-shaped insert 25 is secured within the recess 6 by means of rivets 9 with the open end of the insert facing the lateral support. The ends of both legs 26 and 27 of the U-shaped insert 25 are disposed in line with the face 14 of the frame stave 1. The projection 5 of the lateral support is inserted into the portion of the recess 6 between the legs 26 and 27. If the lateral support 2 with the projection 5 is made of light metal then a pressure plate 28 which is preferably made of tempered steel is mounted on the projection 5 adjacent the leg 26. The pressure plate 28 is secured to the projection 5 by means of a screw 29 which is parallel to the longitudinal axis of the lateral support 2. The end of the pressure plate 28 closest to the lateral support 2 is provided with a bevelled surface 31 perpendicular to the axis of the screw 11. A shoulder 30 on the projection 5 prevents the twisting of the pressure plate 28 and therefore acts as a stopper. In order that the screw head 20 of the screw 11 does not protrude too far beyond the outer edge 10 of the frame stave 1, the frame stave 1 is provided with a recess 32 and the lateral support 2 is provided with a complementary recess 33.

As with the previous embodiments the lateral support in the present embodiment can be freed by merely loosening the screw by a few turns. A hinge pin 35 is located in the extension of the tap hole 34 for the screw 29 and a spring 36 between the hinge pin 35 and the screw 29 tends to bias the hinge pin outwardly of the tap hole 34. At the end of the leg 27 of the U-shaped insert 25 an aperture 37 having a one sided countersink 38 is provided for the reception of the hinge pin 35 when the projection 5 is withdrawn from the recess 6 to the extent necessary to align the hinge pin 35 with the aperture 37. Thus, upon outward movement of the projection 5 the hinge pin 35 will automatically be latched in the aperture 37 to provide a pivot axis for the lateral support relative to the frame stave.

Figure 8:
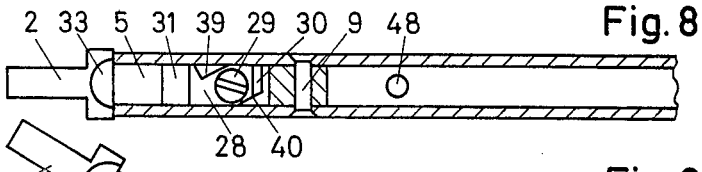
FIG. 8 is a top plan view, partly in section, of the corner joint of FIG. 6 with the lateral support disposed in the plane of the frame stave.
Figure 9:
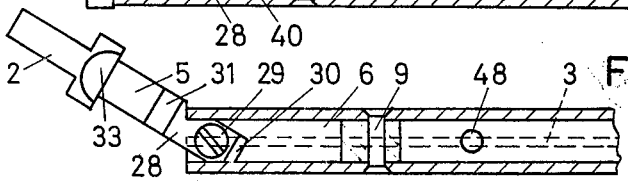
FIG. 9 is a view similar to FIG. 8 with the parts pivoted.

The projection 5 and the pressure plate 28 are provided with an aligned bevelled recess 39 and chamfering 40 which will permit the pivotal movement of the projection 5 within the recess about the pivot axis. FIG. 8 shows the lateral support with the projection 5 in the fully inserted position whereas FIG. 9 shows the lateral support in the partially withdrawn pivoted position. In this manner the end face 14 of the frame stave 1 and the corresponding end of the heddle carrying rod are exposed in order to add or remove heddles from the rod. When the lateral support 2 with the projection 5 is again pushed into the recess 6 the hinge pin 35 will slide over the one sided countersink portion 38 and be cammed back into the tap hole 34.

In the event that the lateral support 2 has to be completely removed from the frame stave 1, the hinge pin 35 can be pushed back into the hole 34 by means of the plunger 41 which is housed in the aperture 37. The plunger 41 can be operated manually by pressing the elastic latch 42 which may be formed of plastic or other suitable resilient material. The end of the plunger 41 which protrudes through the wall 16 of the recess 6 is formed with a head 44 by means of a recess 43. The head 44 is disposed in a T-shaped groove 45 located at the free end of the latch 42. The opposite end 47 of the latch 42 is secured to the inner wall 16 of the frame stave 1 by means of a screw 48. The resilience of the latch 42 is chosen in such a way that a predetermined force is always exerted on the plunger 41 to bias the shoulder 49 of the plunger 41 against the wall 16 to prevent the plunger from being completely withdrawn from the aperture 37. By applying manual pressure to the head piece 46 of the latch 42 the plunger 41 can be pushed in to force the hinge pin 35 out of the aperture 37 to allow for the complete removal of the projection 5 from the recess 6 to separate the lateral support 2 from the frame stave 1. As soon as the projection 5 of the lateral support 2 is freed the hinge pin 35 is biased outwardly by the spring 36 but the pin 35 will be retained by the shoulder 50 which prevents it from coming completely out of the tap hole 34 and getting lost.

While the invention has been particularly shown and described with reference to preferred embodiments thereof it will be understood by those in the art that various changes in form and details may be made therein without departing from the spirit and scope of the invention.

What is claimed is:

1. A heddle frame comprising at least one frame stave having a recess in at least one end thereof, at least one lateral support having a projection protruding from one side thereof adjacent one end of the lateral support and adapted to be inserted in said recess so that said stave and said support are disposed at right angles to each other and connecting means for detachably securing said projection within said recess, said connecting means comprising screw means supported by said stave and extending into operative engagement with said projection in said recess to detachably secure said projection in said recess, said screw means being disposed in the plane of said frame and inclined relative to the longitudinal axis of said stave and said support and said projection being provided with a bearing surface perpendicular to the longitudinal axis of said screw means so that a component of force will be exerted on said projection parallel to said stave to draw said lateral support against the end of said stave and a component of force will be exerted on said projection parallel to said support to clamp said projection in the recess in the stave.

2. A heddle frame as set forth in claim 1 further comprising two plates secured in said recess on opposite sides of said projection with the plate closest to the end of the lateral support having an inclined tap hole in which said screw means is threaded and supported.

3. A heddle frame as set forth in claim 1 wherein said frame stave is provided with a closed T-shaped channel which runs parallel to the longitudinal axis of the stave on the side of said recess closest to the end of said support, key means having an inclined tap hole disposed in said channel for threadedly engaging and supporting said screw means for engagement with said projection and a pressure plate secured in said recess on the opposite side of said projection from said channel.

4. A heddle frame as set forth in claim 1 further comprising a U-shaped support secured in said recess with the open end of said insert flush with the end of said stave for receiving said projection, the leg of said U-shaped insert closest to the end of said support having an inclined tap hole therein for threadedly receiving and supporting said screw means for engagement with said projection.

5. A heddle frame as set forth in claim 4 wherein said projection is provided with a through hole adjacent the free end thereof parallel to the longitudinal axis of said lateral support, a through aperture formed in the other leg of said U-shaped insert adjacent the free end thereof, a movable hinge pin disposed in said through hole and spring means for biasing said hinge pin into said through aperture when said through hole and said through aperture are aligned upon partial withdrawal of said projection from said recess to provide for the pivoting of said lateral support about said hinge pin 6. A heddle frame as set forth in claim 5 wherein said projection is provided with an elongated notch which extends parallel to the lateral support and is provided with a bevelled edge at the free end thereof parallel to said notch which will permit the pivotal movement of the lateral support and projection relative to the stave and provide a limit stop for such pivotal movement.

7. A heddle frame as set forth in claim 5 further comprising plunger means mounted in said through aperture with one end protruding outside said recess and resilient latch means secured at one end to said stave with the opposite end thereof disposed in operative engagement with said one end of said plunger for normally biasing said plunger away from said projection to permit the entry of said hinge pin into said aperture, said resilient latch means adapted to be depressed to move said plunger in said through aperture to force said hinge pin into said through hole to permit the projection to be completely withdrawn from said recess.

8. A heddle frame as set forth in claim 1 wherein the end of said frame stave adjacent the end of said lateral support is provided with a chamfered surface through which said screw means extends so that the head of said screw means will not protrude too much beyond the outer side of said stave.

9. A heddle frame as set forth in claim 1 wherein the adjacent end corners of said lateral support and said stave are cut away to partially recess the head of said screw means within the boundaries of said frame.

10. A heddle frame as set forth in claim 1 wherein said projection is provided with a prism-shaped recess to define an inclined surface against which said screw means bears, said surface being disposed perpendicular to the axis of said screw means.

11. A heddle frame as set forth in claim 1 further comprising plate means secured on the side of said projection adjacent said screw means, said plate having an inclined surface perpendicular to the axis of said screw means against which said screw means bears.

12. A heddle frame as set forth in claim 1 wherein the free end of said projection is provided with bevelled edges to facilitate the insertion of the projection into said recess.

13. A heddle frame as set forth in claim 1 wherein the edges of said recess adjacent the end of said stave are bevelled to facilitate the entry of said projection into said recess.

* * * * *